United States Patent [19]

Engelder

[11] Patent Number: 4,763,258

[45] Date of Patent: Aug. 9, 1988

[54] METHOD AND APPARATUS FOR TRELEMETRY WHILE DRILLING BY CHANGING DRILL STRING ROTATION ANGLE OR SPEED

[75] Inventor: Paul D. Engelder, Rancho Palos Verdes, Calif.

[73] Assignee: Eastman Christensen Company, Salt Lake City, Utah

[21] Appl. No.: 833,139

[22] Filed: Feb. 26, 1986

[51] Int. Cl.[4] ..... G01V 1/40

[52] U.S. Cl. ..... 364/422; 340/853

[58] Field of Search ..... 340/853–859; 367/82; 175/45; 364/422

[56] References Cited

U.S. PATENT DOCUMENTS

| | | | |
|---|---|---|---|
| 3,967,680 | 7/1976 | Jeter | 340/853 X |
| 4,479,564 | 10/1984 | Tanguy | 181/105 |
| 4,647,853 | 3/1987 | Cobern | 324/166 |

*Primary Examiner*—Jerry Smith
*Assistant Examiner*—Clark A. Jablon

[57] ABSTRACT

The cyclic angular dependence of the output of gravitational inclinometers and magnetometers is used to communicate from the well surface to a microprocessor downhole. The microprocessor controls an arbitrary downhole function. Information is communicated to the microprocessor via the inclinometer and magnetometer by selectively rotating the drill string during a data time interval through a predetermined magnitude of angular displacement or angular velocity. Each additional multiple of angular displacement or angular velocity is interpreted as a distinguishable unit of information. A command word is assembled from a sequential plurality of units of information in the microprocessor and a downhole function is executed according to the command word.

20 Claims, 2 Drawing Sheets

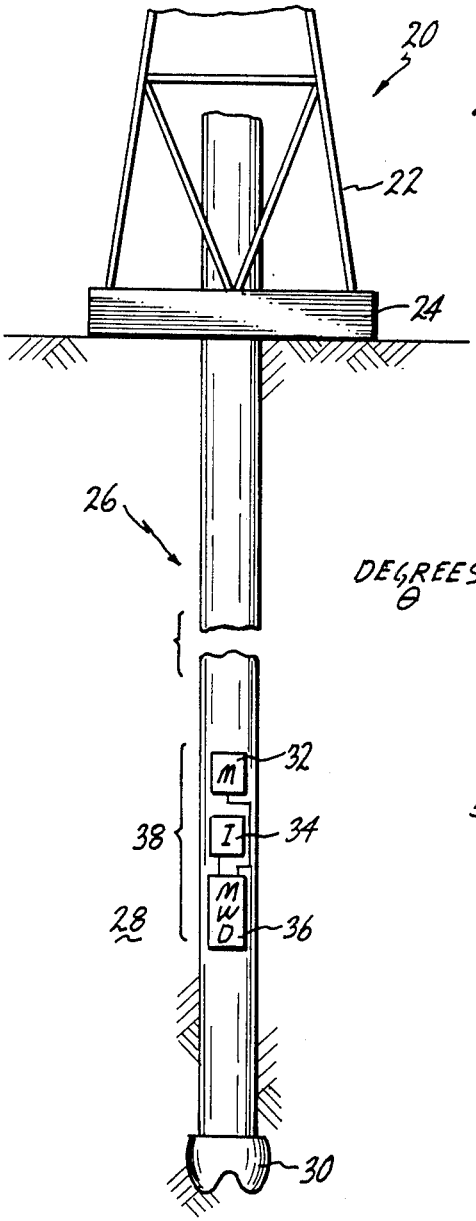
Fig. 1
Fig. 3
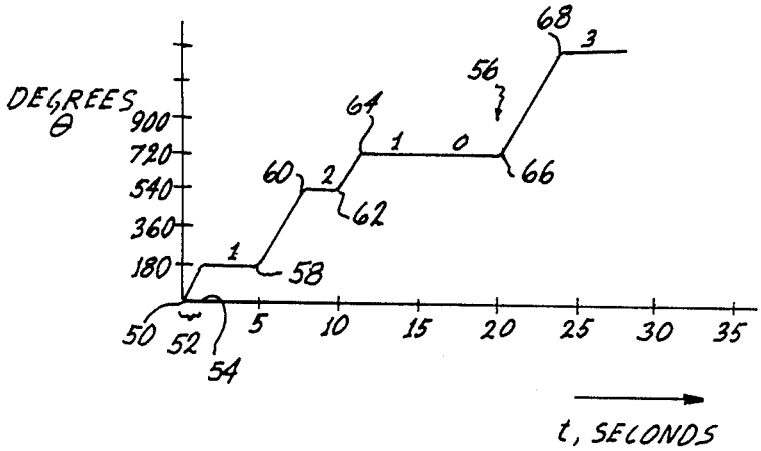
Fig. 4
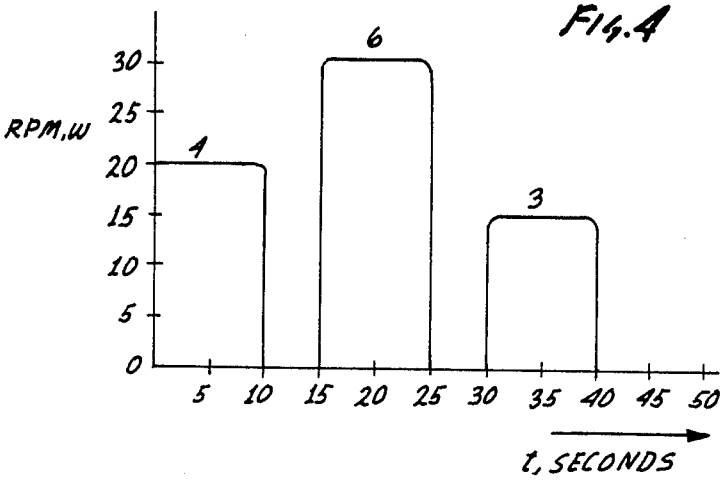

METHOD AND APPARATUS FOR TRELEMETRY WHILE DRILLING BY CHANGING DRILL STRING ROTATION ANGLE OR SPEED

BACKGROUND OF THE INVENTION

1. Field of the Invention

The invention relates to the field of measuring while drilling (MWD) and in particular to the communication of information from downhole within a borehole to the surface by selective manipulation of the angle or speed of rotation of the drill string.

2. Description of the Prior Art

The performance of measurements while drilling have long been practiced in petroleum technology and has become of greater commercial importance. Early activity in MWD technology generally involved communication of a single or few simple parameters between the well surface and at the bottom of the borehole. Typical prior art mechanisms for communicating to the well surface from the downhole location include: a wide variety of mud pulsing techniques for transmission of acoustical waves in the hydraulic column contained within the drill string or in the drill string itself; and radio communication down the drill string or in another types of electrical communication networks built into the drill string including direct wire and distributed networks. Generally, such prior art techniques have been unsatisfactory on account of loss of signal quality and poor data transmission rates, as is typical in the case of mud pulsing systems, or in case of radio and electrical communication systems where complex and delicate communication transmission lines are often unreliable.

For example, Lamel et al, "Telemetry System For Oil Wells," U.S. Pat. No. 3,790,930 shows a typical prior art acoustical communication system for transmitting information by establishing modular torsional acoustic waves in the drill pipe. Lamel shows both the modulation of existing acoustical waves which naturally occur in the drill string and the generation of modulated acoustal waves which are introduced into the drill string. However, as is characteristic of all acoustical transmissions, the system is noise prone, is characterized by a low data transmission rate, and requires sophisticated and delicate transducers or operation.

Park, "Method And Apparatuses for Transmission Of Data From The Bottom Of The Drill String During Drilling Of A Well," U.S. Pat. No. 3,788,136 similarly shows an acoustic system in which torque pulses in the drill string are generated by selectively creating a torsional drag downhole.

Stelzer et al, "Method And Apparatus For Transmission Of Data From Drill Bit In Wellbore While Drilling," U.S. Pat. No. 3,805,606 similarly generates torsional pulses within the drill pipe by engaging a bit through a mechanically, electrically or hydraulically operated clutch which couples and decouples the drill bit from the drill string.

What is needed is a method and apparatus for MWD telemetry which is simple, extremely rugged, uses proven downhole signal sources and which is capable of high fidelity with high data transmission rates.

BRIEF SUMMARY OF THE INVENTION

The invention is a method for communicating information from a well platform downhole comprising the steps of selectively rotating a drill string, and simultaneously measuring a geophysical parameter downhole while rotating the drill string. The step of rotating and measuring is effectuated during a predetermined data time interval. The method continues with the step of converting the geophysical parameter into an unit of information. As a result information is transmitted downhole through selective rotation of the drill string.

In one embodiment the step of selectively rotating the drill string rotates the drill string through selected multiples of angular displacement during the data time interval. Each multiple of the angular displacement corresponds to a distinguishable unit of information.

In another embodiment, the step of selectively rotating the drill string rotates the drill string with a selected multiple of angular velocity during the data time interval. Each multiple of the angular velocity corresponds to a distinguishable unit of information.

In the step of measuring the geophysical parameter, a directional component of terrestrial magnetic field is measured.

In another embodiment in the step of measuring the geophysical parameter, a directional component of terrestrial gravitational field is measured.

It is also contemplated within the invention that in the step of measuring the geophysical parameter, a directional component of terrestrial magnetic field and a directional component of terrestrial gravitational field are simultaneously measured.

The method of the invention further comprises the steps of repeating the steps of selectively rotating, simultaneously measuring and converting to form a sequential plurality of the units of information. Next follows the step of assembling the sequential plurality of the units of information to form a command word. Then a downhole function is executed in response to the command word.

The invention is also characterized as an improvement in an apparatus comprising a drill string, a circuit for selectively rotating the drill string, and transducer circuit for measuring an angularly dependent geophysical parameter downhole. The improvement comprises a circuit for converting an analog output signal from the circuit for measuring the geophysical parameter into digital format. A digital processor circuit is coupled to the circuit for converting. The digital processor circuit converts a measure of periodicity of the geophysical parameter during a predetermined data interval into a distinguishable unit of information. As a result communication downhole is simply and reliably effectuated.

In one embodiment the digital processor circuit converts angular dependence of the geophysical parameter measured by the transducer circuit into the distinguishable units of information.

In another embodiment the digital processor circuit converts angular rate dependence of the geophysical parameter into the distinguishable units of information.

In particular the digital processor circuit converts a sequential plurality of values of the geophysical parameter into a corresponding sequential plurality of distinguishable units of information and assembles a command word from the plurality of units of information. The digital processor circuit is responsive to the command word at least to initiate a downhole function within the drill string.

The invention is also characterized as a method for communicating information downhole comprising the steps of measuring a geophysical parameter downhole with at least one sensor, changing the orientation of the sensor downhole during a predetermined data time interval, determining the cyclic changes in the geophysical parameter dependent upon orientation of the sensor downhole during the data time interval, and converting a determination of the cyclic nature the geophysical parameter downhole during the data time interval into a distinguishable unit of information.

BRIEF DESCRIPTION OF THE DRAWINGS

FIG. 1 is a diagrammatic, cross-sectional depiction of a drill string in which the method and apparatus of the invention is employed.

FIG. 3 is a graph illustrating a first embodiment of the invention wherein the degree of rotation of the drill string is used to transmit information downhole.

FIG. 4 is a graph of a second embodiment in the invention wherein the rate of rotation of the drill string is used to transmit information downhole.

Figure 2:
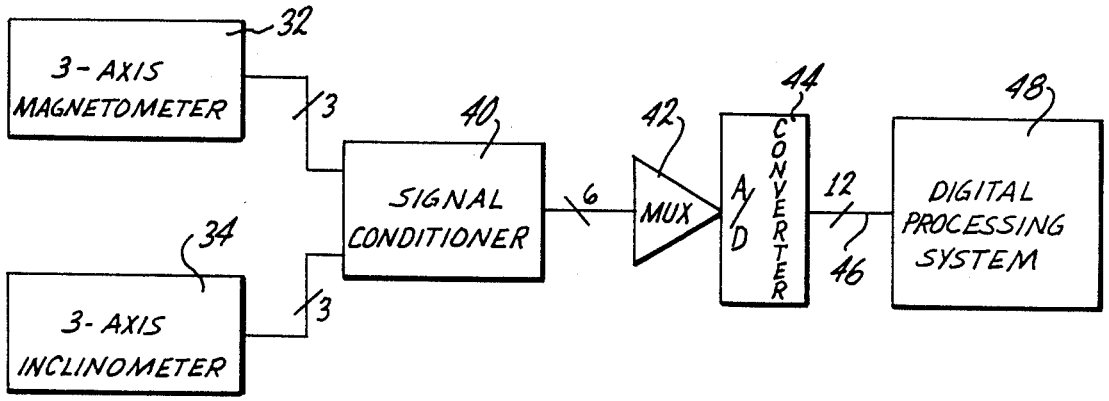
FIG. 2 is a block diagram of a circuit illustrating a first embodiment of the invention wherein measures of rotation of the drill string are digitally processed.

The invention and its various embodiments may be better understood by now turning to the following detailed description.

DETAILED DESCRIPTION OF THE PREFERRED EMBODIMENT

The cyclic angular dependence of the output of gravitational inclinometers and magnetometers is used to communicate from the well surface to a microprocessor downhole. The microprocessor controls an arbitrary downhole function. Information is communicated to the microprocessor via the inclinometer and magnetometer by selectively rotating the drill string during a data time interval through a predetermined magnitude of angular displacement or angular velocity. Each additional multiple of angular displacement or angular velocity is interpreted as a distinguishable unit of information. A command word is assembled from a sequential plurality of units of information in the microprocessor and a downhole function is executed according to the command word.

The invention is a method and apparatus wherein conventional downhole inclinometers and are magnetometers are utilized as rotation sensors to transmit signals or complex commands from the well surface by rotating the drill string through different degrees or different angular rates. For example, when a drill string is rotated in any orientation including the vertical orientation, a magnetometer, which senses the earth's magnetic field downhole, generates a sinusoidal wave of a frequency equal to the angular rate of rotation of the drill string and proportional to the degree of rotation. Similarly, if the drill string is inclined, the inclinometer, which senses the direction and magnitude of gravity downhole, similarly generates a sinusoidal signal equal in frequency to the rate and proportional to the degree of rotation of the drill string. Typically, such MWD magnetometers and inclinometers are used in other conventional MWD equipment and are commonly available transducers or signal sources downhole.

According to the method and apparatus of the invention, commands are communicated downhole to a downhole microprocessor which in turn executes the command through conventional processes. A command is coded as parameter of the rotation of the drill string. For example, in a first embodiment, the command may be communicated through a method of selectively rotating the drill string through predetermined multiples of angular displacement. In a second embodiment, the command is communicated by a method of selectively rotating the drill string at multiples of a predetermined angular rate. In any case, the downhole magnetometers and/or inclinometers sense the rotation of the drill string and provide a signal which can be decoded by the microprocessor and executed.

Turn now to FIG. 1 which shows a diagrammatic depiction of a drill rig, generally denoted by reference numeral 20, comprising a derrick 22, well platform 24 and a drill string, generally denoted by reference numeral 26. Drill string 26 drills a borehole into the rock formation 28 which is diagrammatically depicted in the illustration of FIG. 1 as drilled by drag bit 30, driven by rotation of drill string 26. The drill string is rotated by a kelly and another conventional driving mechanisms comprising part of derrick 22 on platform 24. A conventional magnetometer 32 and inclinometer 34 are incorporated downhole within drill string 26 in a manner well known to the art. Both magnetometer 32 and inclinometer 34 are electrically coupled to a MWD circuit 36. Generally, magnetometer 32 and inclinometer 34 and MWD circuit 36 are all disposed within a MWD sub 38 within drill string 26 and proximate to bit 30. Drill string 26 is diagrammatically depicted in FIG. 1 in a broken cross-sectional view to indicate that the vertical extent of drill string 26 within rock formation 28 is typically deep enough to make the transmission of information downhole by wire or wireless electrical communication or mud pulsing a substantially difficult process.

Turn now to FIG. 2 wherein magnetometer 32, inclinometer 34 and MWD circuit 36 are shown in a block diagram. Magnetometer 32 and inclinometer 34 are three axis devices having three output signals corresponding to an X, Y and Z components of the magnetic and gravitational fields respectively. The conventional coordinate system assumed within the tool, assumes that the vertical is in a Z direction, that the X axis lies in the direction of true north and that the Y axis is orthogonal to both the vertical and north.

The three outputs from magnetometer 32 and inclinometer 34 are coupled to a signal conditioner 40 of conventional design which buffers the output signal of magnetometer 32 and inclinometer 34. The output of signal conditioner 40 is thus six discrete outputs corresponding again to the X, Y and Z components of the magnetic and gravitational fields set at appropriate signal levels compatible with the remaining circuitry. The output of signal conditioner 40 is coupled to the input of a six-to-one multiplexer 42. The output of multiplexer 42 in turn is coupled to a conventional analog-to-digital (A-to-D) converter 44. Multiplexer 42 sequentially couples one of the six outputs of signal conditioner 40 to the single input of A-to-D converter 44 which converts the analog output of signal conditioner 40 into a digital format. The output of A-to-D converter 44 is a 12 bit digital signal coupled to output bus 46. Output bus 46 in turn is provided as an input to a conventional digital processing system 48. Typically, output bus 46 coupled to A-To-D converter 44 will be the data bus (not shown) included within digital processing system 48. Processing system 48 is well known to the art and is typically present in MWD circuitry for other purposes.

A circuit architecture of processing system 48 will not be described here in detail other than to indicate that the architecture is based upon a microprocessor with conventional data, address, and command buses coupling to the microprocessor to memory chips and a plurality input/output buffers or peripherals. Thus it should be clearly understood that the digital signal derived from magnetometer 32 and inclinometer 34 may be processed in any manner now known in the art or later devised without departing from spirit and the scope of the present invention. For example, output 46 of A-To-D converter 44 could be directly coupled to the input ports within a microprocessor rather than connected to a bus structure.

Before considering further implementation of MWD circuitry 36 in combination with magnetometer 32 and inclinometer 34, consider now the methodology as implemented by the circuitry of FIG. 2 as graphically depicted in FIG. 3. In FIG. 3, the vertical axis denotes the angular displacement in degrees through which drill string 26 has been rotated from a reference or initial position. The horizontal axis is time marked in seconds. Initially, the drill string is standing at a reference or initial point 50 labelled as zero degrees. The drill string is rotated one-half of a full turn or 180 degrees during a predetermined time period denoted by reference numeral 52. The position of drill string is then denoted by point 54 on curve 56 of FIG. 3. The predetermined time period 52 is the time required to rotate the drill string through half a rotation, which is typically the order of a few seconds, e.g. 5 seconds. The drill string then remains in a stationary position until a predetermined time interval, e.g. 5 seconds, has elapsed since rotation first began. The drill string is now represented by point 58 on curve 56. A rotation of 180 degrees followed by a stationary state for the predetermined time, such as at point 58 can be interpreted as an encoded digit, such as a one.

After the first 5 second stationary interval, the drill string is again rotated, but in the illustration of FIG. 3, the bit is rotated through an additional 360 degrees to assume the position as represented by point 60 on curve 56. Thereafter the drill string 26 remains stationary until an additional 5 second interval has elapsed. A 360 degree rotation can then be encoded as a distinguishable digit, such as "2."

Similarly, the method continues by varying the amount the amount of rotation in multiples of 180 degrees, or any other distinguishable multiple, in order to represent a symbol or digit. For example, after the drill string reaches point 62 on curve 56 it can then again be rotated 180 degrees to achieve position 64 on curve 56 which would represent a second digit "1." Thereafter the drill string would remain stationary through the next subsequent of 5 second interval. Lack of rotation during a data interval time will thus be interpreted as a zero digit, "0". After the drill string had then reached point 66 on curve 56, it could be further rotated through one and one-half cycles or 540 degrees to assume the position indicated by point 68 on curve 56 which would be denoted as a numeral "3."

The magnitude of angular displacement taken as the unit of distinguishable rotation can be varied according to the invention. The only limitation is the limitation of MWD circuit 36 to distinguish the output signals of magnetometer 32 and inclinometer 34, which are periodic over a 360 degrees range of drill string rotation, and the ability of the drill crew to rotate drill string 26 through controlled magnitudes of angular displacement.

Whatever may be the unit of angular displacement chosen for symbolization of distinguishable signals from which commands can be built, the analog and sinusoidal magnetic field and gravitational field is sampled through the circuitry of FIG. 2 and its magnitude over the data interval is determined. As the magnetic and gravitational fields undergo a single phase reversal during the data interval, it can be interpreted as a first predetermined signal or "1". If there is no phase reversal during the interval then it is interpreted as a zero. Similarly two phase reversals during data interval is interpreted as a complete revolution and as a second predetermined signal or as of "2". The number of predetermined signals can be multiplied limited only by the number of rotations which can be conveniently and practically completed and controlled during a data interval. For example, in the illustrated embodiment with the data intervals 5 seconds, the A-TO-D converter samples each one of the six conditioned magnetic and gravitational signals 6 times per second. These data points are stored during the first portion of data interval when drill string 26 is rotating in corresponding memory locations within digital processing system 48. Thereafter, the data is analyzed as discussed above, the number of phase reversal during the data interval are determined, and the information unit or digit is interpreted therefrom. The digits are then combined according to the information protocol which may be arbitrarily chosen to fabricate a command word. The word is then used by a microprocessor included within digital processing system 48 to arbitrarily execute any downhole command according to software control as may be desired.

Turning now to an alternative embodiment and to the methodology as graphically depicted in FIG. 4. The vertical axis of FIG. 4 is the angular rotation rate in rotations per minute. The horizontal rate is again a time. In the illustration of FIG. 4, the data interval is selected as a 10 second interval during in which drill string is rotating followed by a 5 second pause during which drill string 26 is stationary. In the methodology as illustrated in FIG. 4, the rpm rate of the drill string is interpreted as corresponding to distinguishable units or digits of information. For example, in the first data interval between 0 and 15 seconds, drill string 26 is shown as rotating at a 20 rpm rate. This is interpreted in the illustrated embodiment as corresponding to a digit, "4." During the second interval between 15 and 30 seconds, the drill string is then rotated at 30 rpm which is interpreted as a "6." After a 5 second quiescent period, the drill string is then rotated at 15 rpm which is interpreted as a "3." In the illustrated embodiment of FIG. 4, each increment of 5 rpm is interpreted as an additional digit. Other quantifications of the angular rate could be employed for coding without departing from the scope of the invention.

The circuitry of FIG. 2 can also be used to implement the methodology depicted in FIG. 4. For example, drill string 26 rotating at 20 rpm for 10 seconds undergoes approximately $3\frac{1}{3}$ revolutions and the magnetic and gravitational fields will undergo $6\frac{2}{3}$ phase reversals. Each additional 5 rpm will add $1\frac{2}{3}$ phase reversals over the 10 second data interval. Alternatively, it might be desired to have a minimum of two phase reversal or one rotation to represent the minimum distinguishable increment in rotational velocity. The distinguishable increments of speed or the data interval could be appropriately adjusted to achieve this result. Thus, increments of 6 rpm could increase the number of phase reversals by an even multiple during each 10 second interval. Where rate increments of 5 rpm are desired, the data interval could be expanded to 12 seconds to give the required two phase reversals per data interval.

If a single phase reversal is used to represent the smallest distinguishable change in phase, then each of these parameters could be halved. In other words, rpm increments over a 10 second data interval as small as 3 rpm could represent distinguishable characters. Alternatively increments of 5 rpm over a 6 second data interval would also then represent distinguishable characters or signals.

Figure 5:
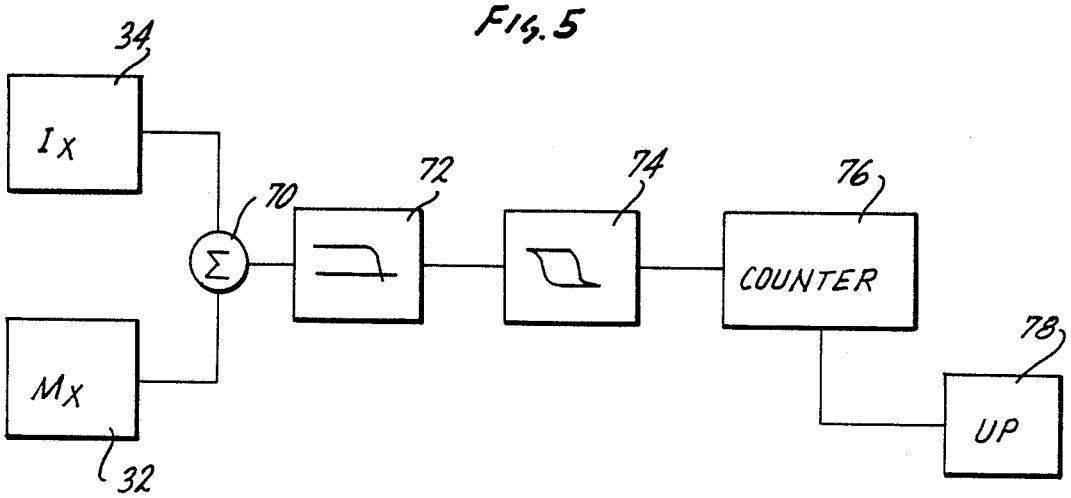
FIG. 5 is a block diagram of a circuit according to a second embodiment wherein velocity of rotation is processed in part in analog form.

Turning now to FIG. 5 which represents an alternative implementation wherein the methodology of FIG. 4 can be practiced. Again, magnetometer 32 and inclinometer 34 would produce analog output signals, each of which would be summed at a summing point 70. The output of summing point 70 would then be conditioned by a low pass filter 72 whose output is then coupled to a Schmitz trigger 74. The output of trigger 74 would then be a peak count which would be accumulated during a data interval within a counter 76. Thereafter, the output of counter 76 would be clocked into a conventional microprocessor 78 for data processing according to the invention.

In the illustration of FIG. 5, a single component of the gravitational field and magnetic field is measured. For example, the component aligned with the true north or X direction could arbitrarily be chosen as the monitored output signal. Thus, the output of inclinometer 34 and magnetometer 32 would always be substantially in phase with each other and thus form a redundant pair of sensors.

In the preferred embodiment, the circuitry of FIG. 2 is employed rather than circuitry of FIG. 5 inasmuch as MWD circuit 36 already has a digital processing system in place for other downhole operations, namely the directional sensing normally employed with magnetometer 32 and inclinometer 34. Thereafter, rather than attempting to execute a portion of the data processing in analog form as is contemplated in FIG. 5, the analog signal is measured and immediately converted into digital format for further processing as discussed in connection with in FIG. 2.

Many modifications and alterations may be made by those having ordinary skill in the art without departing from the spirit and the scope of the invention. Therefore, the illustrated embodiment has been shown only by way of example and should not be taken as limiting the invention which is defined by the following claims.

I claim:

1. A method for communicating well platform information from a well platform downhole comprising the steps of:

selectively rotating a drill string according to said well platform information to be communicated downhole;

simultaneously measuring downhole an angularly dependent geophysical parameter while rotating said drill string, said step of rotating and measuring being effectuated during a predetermined data time interval; and converting downhole variations of said geophysical parameter, which variations arise during said step of selectively rotating said drill string in accordance with said well platform information, into corresponding information so that said well platform information is transmitted downhole through selective rotation of said drill string.

2. The method of claim 1 where said step of selectively rotating said drill string comprises the step of selectively rotating said drill string through predetermined multiples of angular displacement during said data time interval, each predetermined multiple of said angular displacement corresponding to a distinguishable unit of information.

3. The method of claim 2 where in said step of measuring said geophysical parameter, a directional component of terrestrial magnetic field is measured.

4. The method of claim 2 where in said step of measuring said geophysical parameter, a directional component of terrestrial gravitational field is measured.

5. The method of claim 2 where in said step of measuring said geophysical parameter, a directional component of terrestrial magnetic field and a directional component of terrestrial gravitational field are simultaneously measured, to provide redundant measurements.

6. The method of claim 2 further comprising the steps repeating said steps of selectively rotating, simultaneously measuring and converting to form a sequential plurality of units of information;

assembling said sequential plurality of said units of information to form a command word; and executing a downhole function and response to said command word.

7. The method of claim 1 where said step of selectively rotating said drill string comprises selectively rotating said drill string with predetermined multiples of an angular velocity during said data time interval, each predetermined multiple of said angular velocity corresponding to a distinguishable unit of information.

8. The method of claim 7 where in said step of measuring said geophysical parameter, a directional component of terrestrial magnetic field is measured.

9. The method of claim 7 where in said step of measuring said geophysical parameter, a directional component of terrestrial gravitational field is measured.

10. The method of claim 7 where in said step of measuring said geophysical parameter, a directional component of terrestrial magnetic field and a directional component of terrestrial gravitational field are simultaneously measured, to provide redundant measurements.

11. The method of claim 7 further comprising the steps of:

repeating said steps of selectively rotating, simultaneously measuring and converting to form a sequential plurality of units of information;

assembling said sequential plurality of said units of information to form a command word; and executing a downhole function and response to said command word.

12. The method of claim 1 where in said step of measuring said geophysical parameter, a directional component of terrestrial magnetic field is measured.

13. The method of claim 12 where in said step of measuring said geophysical parameter, a directional component of terrestrial gravitational field is measured, to provide redundant measurements.

14. The method of claim 1 where in said step of measuring said geophysical parameter, a directional component of terrestrial gravitational field is measured.

15. The method of claim 1 further comprising the steps of:

repeating said steps of selectively rotating, simultaneously measuring and converting to form a sequential plurality of units of information;

assembling said sequential plurality of said units of information to form a command word; and executing a downhole function and response to said command word.

16. In an apparatus comprising a drill string, platform means for selectively rotating said drill string, and transducer means for generating an analog output signal corresponding to the magnitude of an angularly dependent geophysical parameter downhole, an improvement comprising:

digitizer means for converting said analog output signal from said transducer means into digital data; and a digital processor means coupled to said digitizer means, said digital processor means for interpreting a measure of periodicity of said geophysical parameter during a predetermined data interval as a distinguishable unit of information, so that communication downhole is simply and reliably effectuated by said platform means for selectively rotating said drill string in accordance with information to be communicated downhole, selective rotation being sensed downhole by said transducer means, converted into digital data by said digitizer means, and being interpreted downhole by said digital processor means as said information.

17. The improvement of claim 16 wherein said digital processor means converts angular displacement dependence of said geophysical parameter measured by said transducer means into said distinguishable units of information.

18. The improvement claim 16 wherein said digital processor means converts angular rate dependence of said geophysical parameter into said distinguishable units of information.

19. The improvement of claim 16 wherein said digital processor means converts a sequential plurality of values of said geophysical parameter into a corresponding sequential plurality of distinguishable units of information and assembles a command word from said plurality of units of information, said digital processor means being responsive to said command word to at least initiate a downhole function within said drill string.

20. A method for communicating information downhole on a drill string comprising the steps of:

measuring a geophysical parameter downhole with at least one sensor;

selectively changing the orientation of said sensor downhole during a predetermined data time interval in accordance with said information to be communicated downhole by selective rotation of said drill string;

determining the cyclic changes in said geophysical parameter dependent upon orientation of said sensor downhole during said data time interval; and converting said determination of said cyclic nature of said geophysical parameter downhole during said data time interval into a distinguishable unit of information in accordance with said step of selectively changing the downhole orientation of said sensor, so that information is reliably communicated downhole.

* * * * *